US009352902B2

(12) United States Patent
Wong

(10) Patent No.: US 9,352,902 B2
(45) Date of Patent: May 31, 2016

(54) FREIGHT CONTAINER

(71) Applicant: Leung Tim Wong, Kowloon (HK)

(72) Inventor: Leung Tim Wong, Kowloon (HK)

( * ) Notice: Subject to any disclaimer, the term of this patent is extended or adjusted under 35 U.S.C. 154(b) by 0 days.

(21) Appl. No.: 14/602,075

(22) Filed: Jan. 21, 2015

(65) Prior Publication Data

US 2015/0266666 A1 Sep. 24, 2015

(30) Foreign Application Priority Data

Mar. 21, 2014 (GB) ..... 1405071.0

(51) Int. Cl.

| | |
|---|---|
| ***B65D 88/00*** | (2006.01) |
| ***B65D 88/12*** | (2006.01) |
| ***B65D 88/52*** | (2006.01) |
| ***B65D 90/00*** | (2006.01) |
| ***B65D 90/02*** | (2006.01) |
| ***B65D 90/18*** | (2006.01) |

(52) U.S. Cl.

CPC ..... *B65D 88/005* (2013.01); *B65D 88/12* (2013.01); *B65D 88/524* (2013.01); *B65D 90/008* (2013.01); *B65D 90/0086* (2013.01); *B65D 90/02* (2013.01); *B65D 90/18* (2013.01)

(58) Field of Classification Search

CPC ..... B65D 88/005; B65D 90/0086; B65D 88/524; B65D 90/18; B65D 88/12; B65D 90/02; B65D 90/008; B65D 21/086; B65D 21/08; B65D 9/22; B65D 9/18; B65D 9/14; B65D 9/12

USPC ..... 220/6, 666, 520, 9.2, 9.3, 8, 23.87, 220/4.28, 1.5; 206/600; 217/13, 12 R, 14, 217/15, 43 R, 45, 46, 47

See application file for complete search history.

(56) References Cited

U.S. PATENT DOCUMENTS

| | | | | | |
|---|---|---|---|---|---|
| 3,570,698 | A * | 3/1971 | Dougherty | B65D 88/524 | 217/15 |
| 3,966,075 | A | 6/1976 | Schultz | | |
| 5,170,901 | A * | 12/1992 | Bersani | E04B 1/3431 | 220/1.5 |
| 5,190,179 | A * | 3/1993 | Richter | B65D 90/008 | 220/1.5 |
| 2012/0061390 | A1 * | 3/2012 | Giesbers | B65D 90/008 | 220/7 |

FOREIGN PATENT DOCUMENTS

| | | | |
|---|---|---|---|
| WO | 2010/075607 | A1 | 7/2010 |
| WO | 2010/104378 | A1 | 9/2010 |
| WO | 2010/104378 | A8 | 9/2010 |
| WO | 2012/036544 | A1 | 3/2012 |
| WO | 2013/110181 | A1 | 8/2013 |

* cited by examiner

*Primary Examiner* — Robert J Hicks
*Assistant Examiner* — Kareen Thomas
(74) *Attorney, Agent, or Firm* — Ladas & Parry, LLP

(57) ABSTRACT

The present invention is concerned with a novel freight container with improved characteristics. The container has a first portion and a second portion. The container is adapted to assume a first configuration in which the container has a maximum volume and a third configuration in which said container has a minimum volume. In the first configuration, the second portion is extended away from said first portion; side walls of said first and second portions are extending vertically in normal use; and at least some of said side walls are foldable. In the second configuration said side walls are folded in such a way to allow top walls of the first and second portions and bottom walls of the first and second portions be brought towards and adjacent each other whereby the minimum volume of the container is achieved.

20 Claims, 22 Drawing Sheets

FREIGHT CONTAINER

CROSS REFERENCE TO RELATED APPLICATION

This application claims priority from UK Patent No. GB1405071.0 filed Mar. 21, 2014, contents in its entirety are incorporated therein.

FIELD OF THE INVENTION

The present invention is concerned with a novel, and improved, freight container, e.g. for transporting cargos, and a method of operating such container.

BACKGROUND OF THE INVENTION

In the past century, there has been increasing trade of physical goods from different countries across the world. While transportation of these goods may be speedily achieved by air, the cost of cargo transportation by air is relatively high. As such, the primary mode of cargo transportation is conducted by sea. Cargo transportation by sea can be conveniently conducted by packing goods into standardized freight containers which are typically made of steel cases resembling boxes. These freight containers can be loaded into container ships easily at terminals. On arrival, these freight containers can be easily moved to the destination terminals by cranes. Depending on the needs of the recipients, an entire container can be loaded on container truck for subsequent onward ground transportation.

One problem which has however arisen is that, due to imbalance of trade between countries, e.g. the United States and Asian countries, some countries receive significantly more freight containers containing goods. One approach to deal with empty freight containers would be to send them back to originating countries. The problem with this approach is that the cost of transporting empty freight containers is high. At the time of filing this application, it is reported that the cost of transporting an empty container, for example, from inland to the coast in the United States is about US$1,300. There is further cost to transport an empty container from the coast to, for example, Asia. It is to be noted that the cost of a new container typically ranges from US$1,800-2,200. In view of the relatively small cost discrepancy between shipping back empty containers and acquiring fresh containers, there is little economic incentive for transportation companies to ship empty containers from countries which acquire more goods back to the originating countries due trade imbalance. It can thus be envisaged that, during the last few decades, there is accumulated a large number of empty freight containers in countries (e.g. the Unites States) which import more goods than they export. These empty freight containers end up sitting and rusting in dump yards. This is neither economical nor environmental friendly.

The present invention seeks to provide a solution to address these problems, or at least to provide alternatives to the public.

SUMMARY OF THE INVENTION

According to a first aspect of the present invention, there is provided a freight container comprising a first (container) portion and a second (container) portion, wherein the container is adapted to assume a first configuration in which said container has a maximum volume, a second configuration, or a third configuration in which the container has a minimum volume, and wherein in the first configuration the second portion is extending away from said first portion; in the first configuration side walls of the first and second portions are extending vertically in normal use; at least some of the side walls are foldable; and in the third configuration the side walls are folded in such a way to allow top walls of the first and second portions and bottom walls of the first and second portions be brought towards and adjacent each other whereby the minimum volume of the container is achieved.

Preferably, in the second configuration, the second portion may be substantially and telescopically received in the first portion but the top walls of the first and second portions are not brought towards or closer to each other.

Suitably, the side walls of the first portion may be foldable in mid-region thereof and positionable on top of the first portion.

In an embodiment, the side walls of the second portion may be foldable in mid-region thereof and adapted to be brought towards each other whereby the top wall and the bottom wall of the second portion may be brought towards each other.

In one embodiment, the first portion may include a door for closing an open end thereof and movable to situate above and lie on the top wall of the first portion, and the second portion may include a door for closing an open end thereof and movable to situate above and lie on the top wall of the first or second portion. The open ends represent opposite ends of the container.

Advantageously, the freight container may comprise floating hinges allowing the doors to move to and lie on the top wall of the first or second portion.

In a specific embodiment, in the first configuration the length of the container may be of substantially 40 feet, and in the second or third configuration the length of the container may be substantially 20 feet. The freight container, in the first configuration or the second configuration, may be adapted to be compatible with standard size freight containers or the existing freight transportation system Preferably, the freight container may comprise connectors arranged at corners of the first portion and the second portion. The connectors of the first portion and the connectors of the second portion may be sized or otherwise configured differently to compensate for difference in height of the first and second portions, such that two of such containers regardless of state of configuration are stackable in a leveled manner on top of each other.

In a preferred embodiment, the freight container may comprise foldable means for supporting the top wall and the bottom wall of the first portion. At least part of or elements of the foldable means may mechanically connect at least some pairs of said connectors. The foldable means may include hinge means. In a specific embodiment, the foldable means may include a first pair of foldable members movable towards each other during folding and when bringing the top walls and the bottom walls of the first and second portions towards each other. The foldable means may include a pair of second foldable members, and hinge members of the second foldable members may be movable towards the door of the first portion.

In a preferred embodiment, the freight container may comprise a drive mechanism for controlling vertical expansion or collapsing of the container. The drive mechanism may include a pair of threaded elongate rods extending from front end to rear end of the first portion, and a pair of leg members movable with respect to and threadedly connected to the threaded elongate rods at one end and pivotably connected to the top wall of the first portion at the other end, such that when the leg members are caused to move along the threaded rods, the top wall and the bottom wall of the first container are brought towards or away from or towards each other.

In another preferred embodiment, the freight container may comprise a cam mechanism for effecting sliding of the second portion within the first portion. The cam mechanism may include a roller at a lower end of the first portion and a guide defining an engaging surface at bottom surface of the second portion, such that the second portion is slidable towards the first portion when the engaging surface of the guide slides on the roller. The roller may be provided with teeth, and the engaging surface may be provided with complementary teeth, for assisting movement of the second portion on the roller.

According to a second aspect of the present invention, there is provided a freight container comprising a first portion and a second portion, wherein the container is adapted to assume a first configuration in which said container has a maximum volume or a third configuration in which said container has a minimum volume, and wherein in the first configuration the second portion is extending away from the first portion, in the first configuration side walls of the first and second portions are extending vertically in normal use, at least some of the side walls are foldable, in the third configuration the side walls are folded in such a way to allow top walls of the first and second portions and bottom walls of the first and second portions be brought towards and adjacent each other whereby the minimum volume of the container is achieved, and the side walls of the first portion are foldable in mid-region thereof and positionable on top of the first portion.

According to a third aspect of the present invention, there is provided a freight container comprising a first (container) portion and a second (container) portion, wherein the container is adapted to assume a first configuration in which the container has a maximum volume, a second configuration, or a third configuration in which the container has a minimum volume, and wherein in the first configuration the second portion is extending away from the first portion, in the first configuration side walls of the first and second portions are extending vertically in normal use, at least some of the side walls are foldable, and in the third configuration the side walls are folded in such a way to allow top walls of the first and second portions and bottom walls of the first and second portions be brought towards and adjacent each other whereby the minimum volume of the container is achieved. Preferably, in the second configuration the freight container may be shortened to about half a length of the freight container in the configuration. For example, in the second configuration, the freight container may be adapted such that the second portion is situated above or at a side of the first portion.

BRIEF DESCRIPTION OF THE DRAWINGS

Some embodiments of the present invention will now be explained, with reference to the accompanied drawings, in which.

DETAILED DESCRIPTION OF THE INVENTION AND PREFERRED EMBODIMENTS THEREOF

The present invention is concerned with a freight container with variable length and/or collapsible height.

Figure 1:
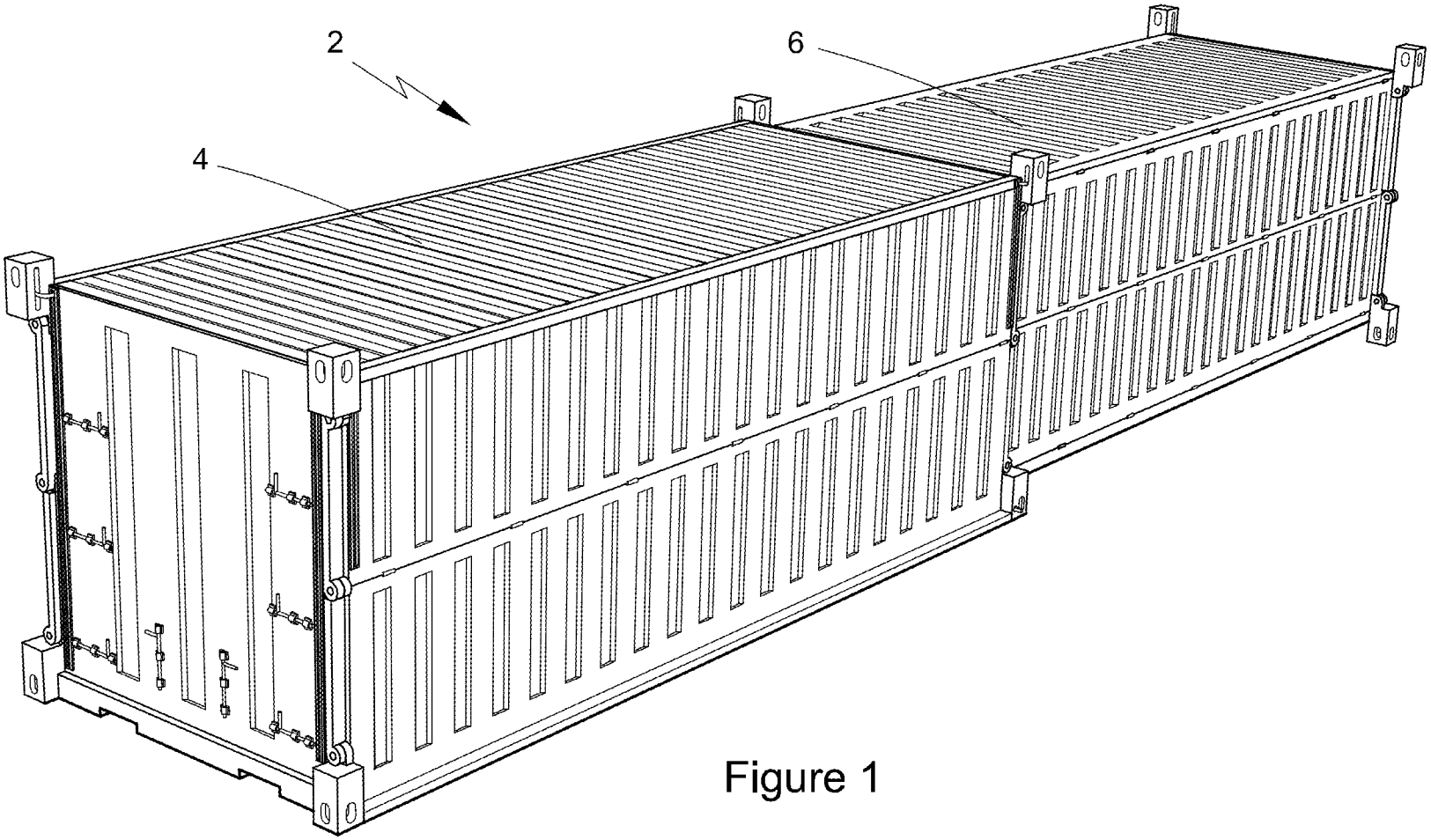
FIG. 1 is a schematic diagram showing a perspective view of an embodiment a freight container in a fully expanded configuration.

In an embodiment, the freight container, designated 2, has two main sections, namely an outer (or external) section 4 and a slide-in (or inner) section 6. For ease of reference, the outer section 4 and the slide-in-section 6 are also referred as first (container) portion and second (container) portion, respectively. FIG. 1 shows that the freight container 2 is in its expanded configuration in which it has a maximum volume, i.e. maximum height and maximum length. In this embodiment, the length of the freight container 2 is substantially 40 feet.

Figure 2:
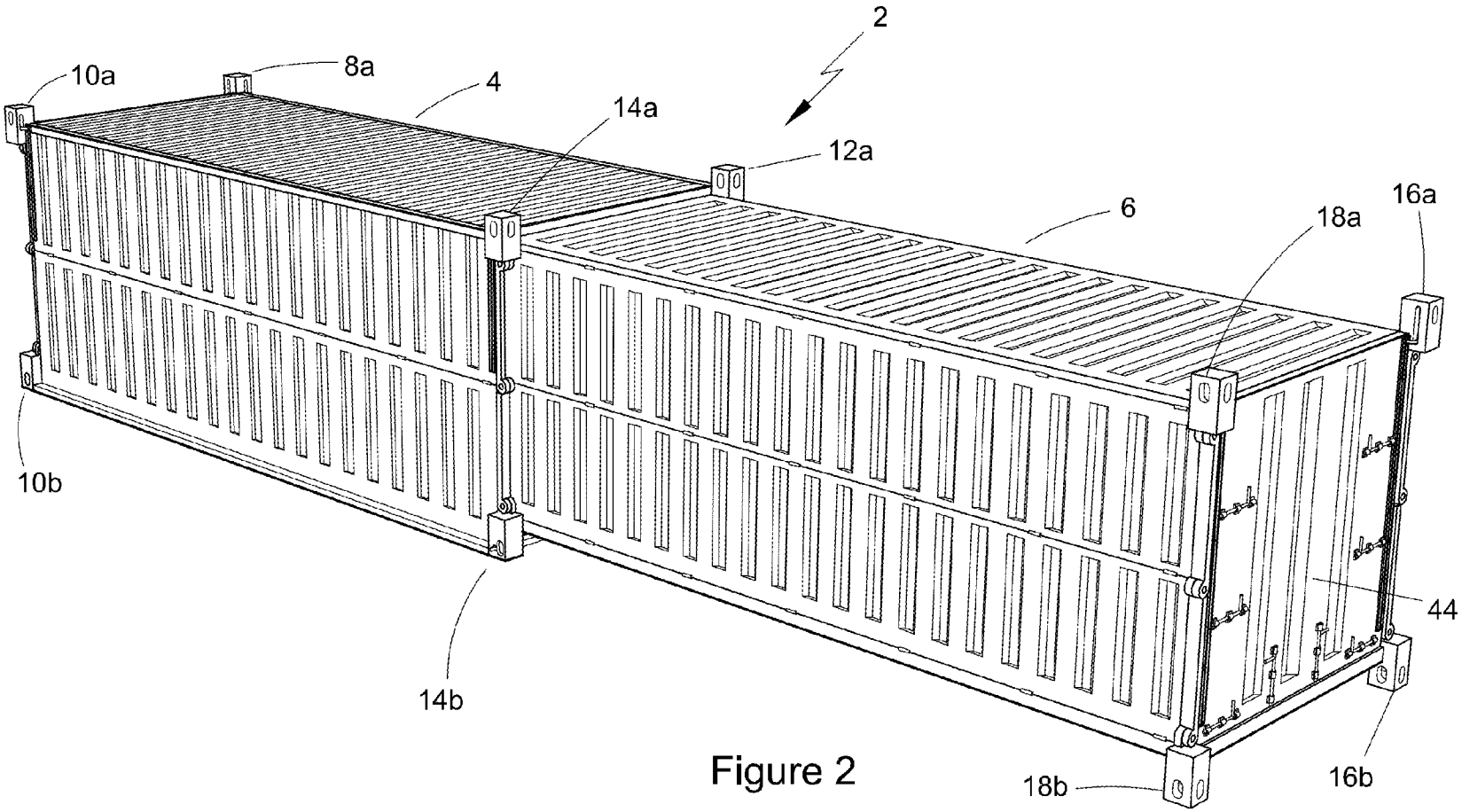
FIG. 2 is an alternative perspective view of the container of FIG. 1.

FIG. 2 is similar to FIG. 1, and it is also a perspective view of the freight container 2 from an end of the slide-in section 6.

The outer section 4 has four top corners at which four connectors 8*a*, 10*a*, 12*a*, 14*a* are provided. The slide-in section 6 has two connectors 16*a* 18*a* at top proximal end thereof. In other words, the freight container 2 has six connectors 8*a*, 10*a*, 14*a*, 16*a*, 18*a* on the top. The outer section 4 has four bottom corners at which four further connectors 8*b*, 10*b*, 12*b*, 14*b* are provided. The slide-in section 6 has two connectors 16*b*, 18*b* at bottom proximal end thereof. In other words, the freight container 2 has six connectors 8*b*, 10*b*, 12*b*, 14*b*, 16*b*, 18*b* at the bottom. It is envisaged that in use, two such freight containers 2 may be stacked up such that the six bottom connectors 8*b*, 10*b*, 12*b*, 14*b*, 16*b*, 18*b* of the freight container 2 from above rest on the six top connectors 8*a*, 10*a*, 12*a*, 14*a*, 16*a*, 18*a* of a like freight container 2 from below.

Figure 3:
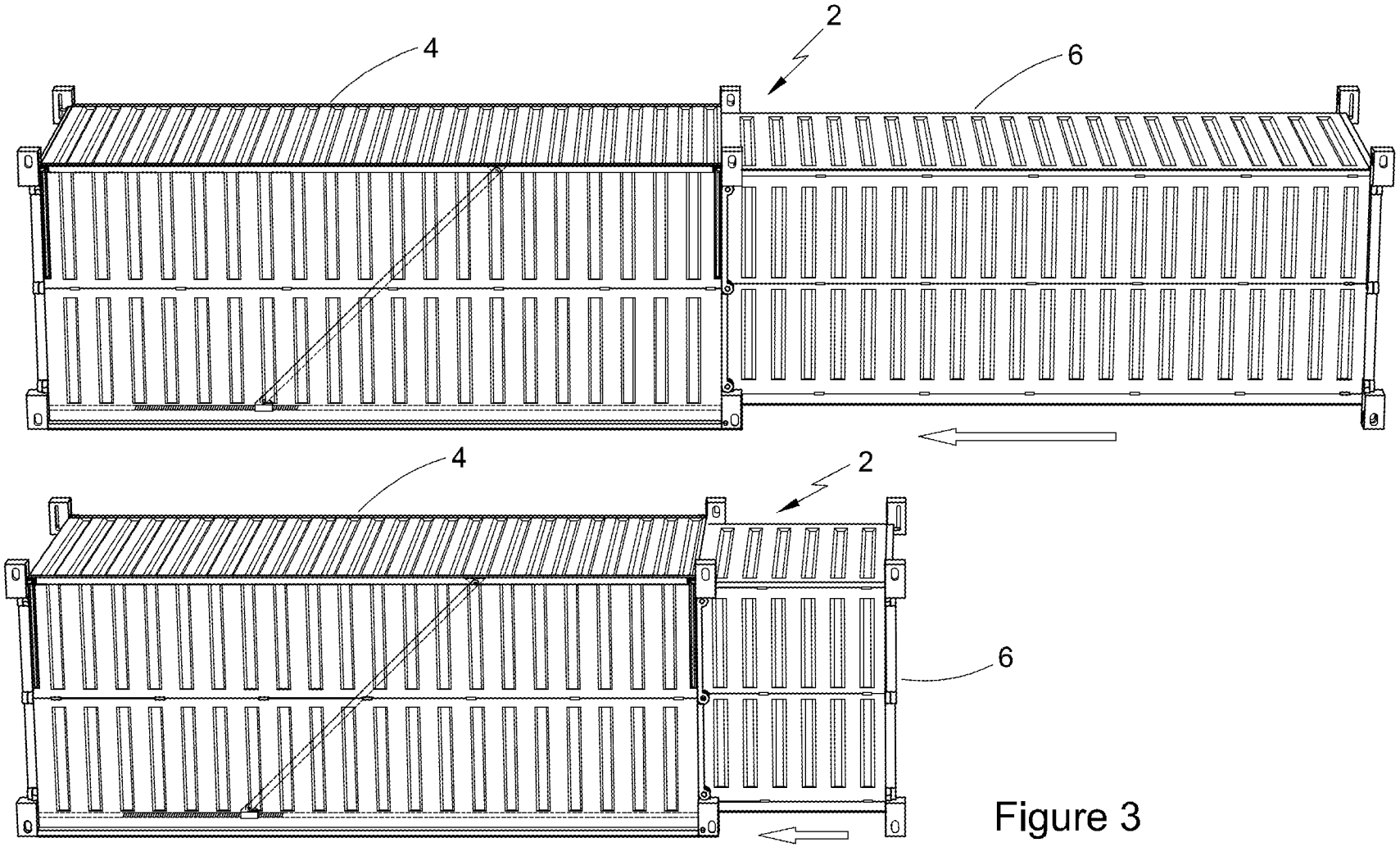
FIG. 3 is a series of two diagrams showing the container in the expanded or elongate configuration of FIG. 1 transforming to a contracted or shortened configuration although the height of the container remains unchanged.
Figure 4:
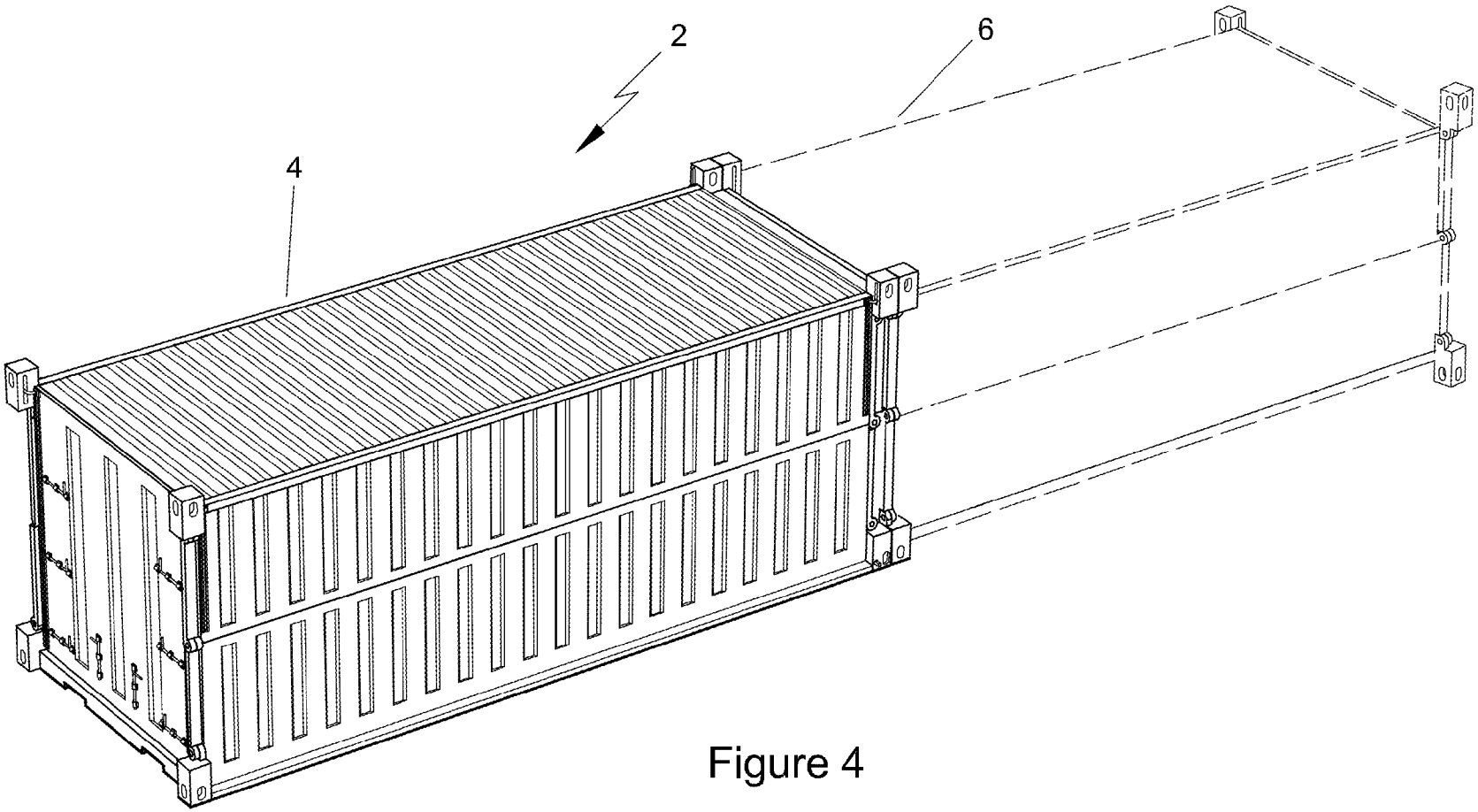
FIG. 4 is a diagram showing the container in a fully contracted or shortened configuration.

FIG. 3 shows the freight container 2 in that the slide-in section 6 can slide into the outer section 4 such that the slide-in section 6 is fully received in the outer section 4. Upper diagram of FIG. 3 shows the freight container 2 before the slide-in section is received in the outer section 4 and lower diagram of FIG. 3 shows the freight container 2 when the slide-in section 6 is being received by the outer-section 4. FIG. 4 is similar to FIG. 3 but shows that the slide-in section 6 is fully received by the outer-section 4.

Figure 5:
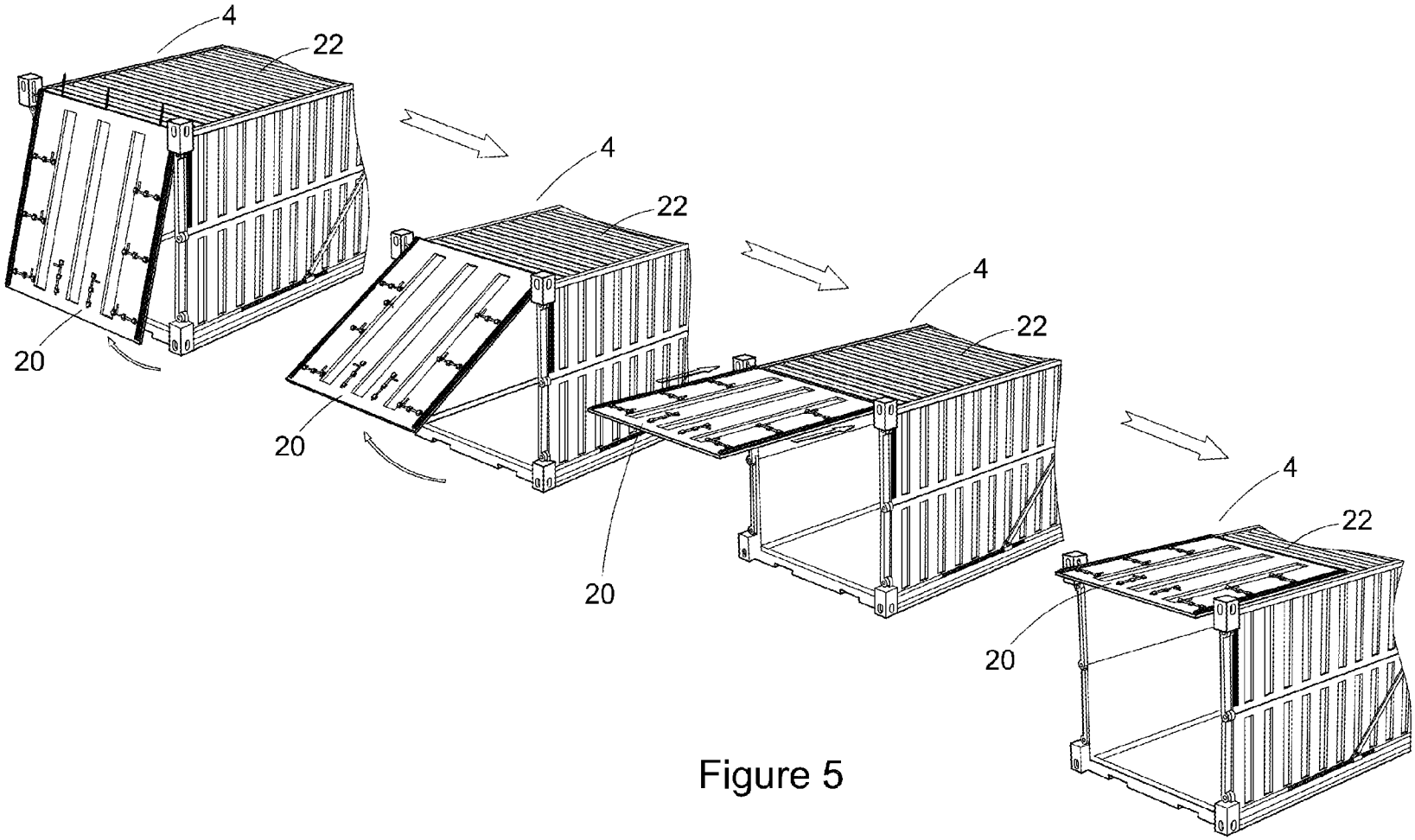
FIG. 5 is a series of four diagrams showing a door at one end of the container movable from the end for closing the container to situate on top of the container.

The outer section 4 has an open end closed by a door 20. The door 20 is somewhat similar to a door of a typical freight container which can be opened or closed allowing goods be loaded into or unloaded from the freight container. There are however differences. FIG. 5 shows that different from the door of a conventional freight container, the door 20 can be folded upwardly and slide to lie on top wall 22 of the outer section 4.

FIG. 5 shows a successive of four diagrams. At the far left diagram, it is shown that the door 20 is being unlocked from the lower end. At the second diagram, it is shown that the entire door 20 is being lifted upwardly. At the third diagram, it is shown that the door 20 is further upwardly lifted such that it lies flat horizontally and substantially in same plane of the top wall 22 of the freight container 2. At the far right diagram, it is shown that the door 20 is slid towards and rests on the top wall 22 of the freight container 2.

Figure 6B:
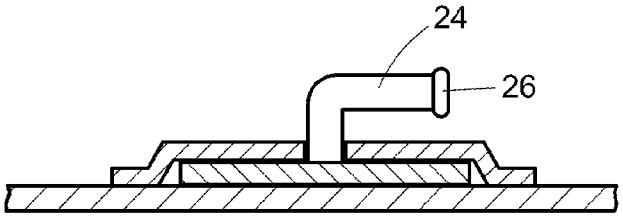
FIG. 6*b* is part of the folding hinge shown in FIGS. 6*a*-6*c;*
Figure 6C:
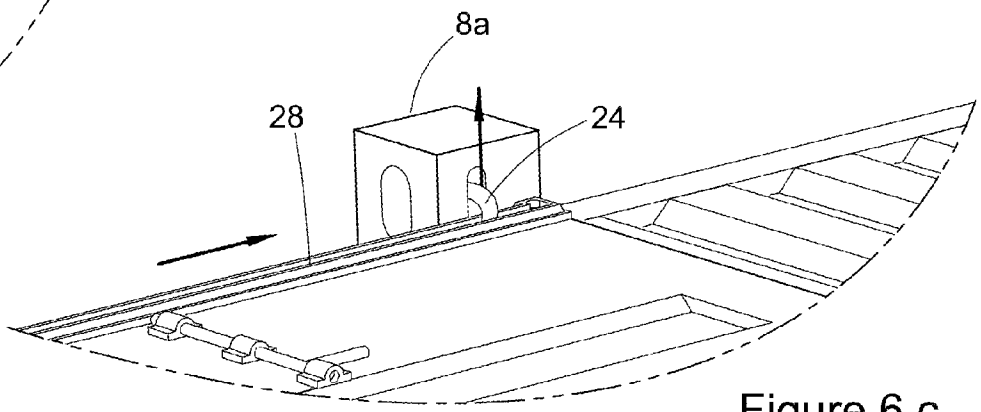
FIGS. 6*a* and 6*c* are schematic diagrams showing a part of the door of FIG. 5 and a folding hinge at a top corner of the container, the folding hinge allowing the door to move from the end to situate on top of the container.
Figure 6A:
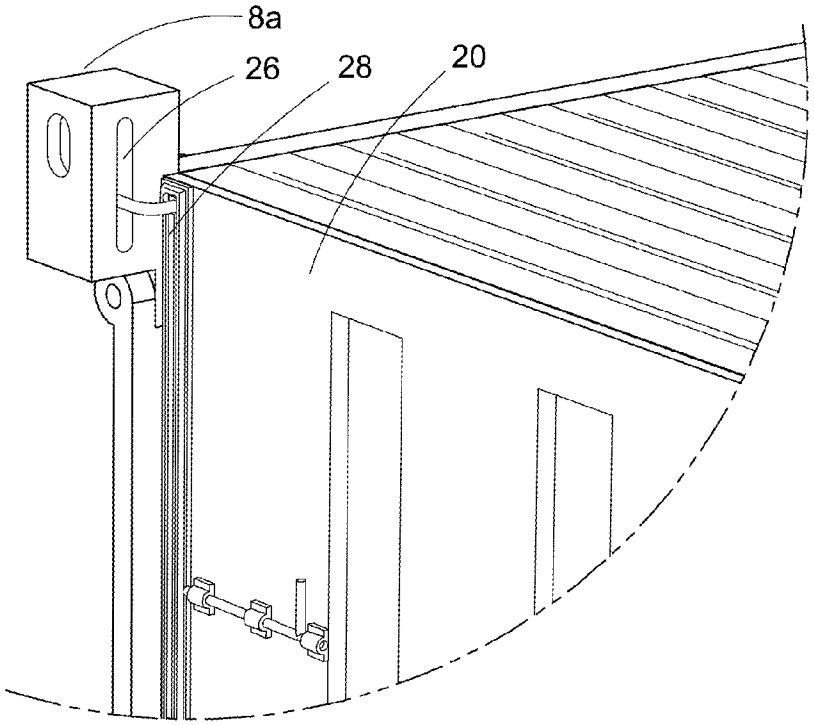
Figures 7A, 7B:
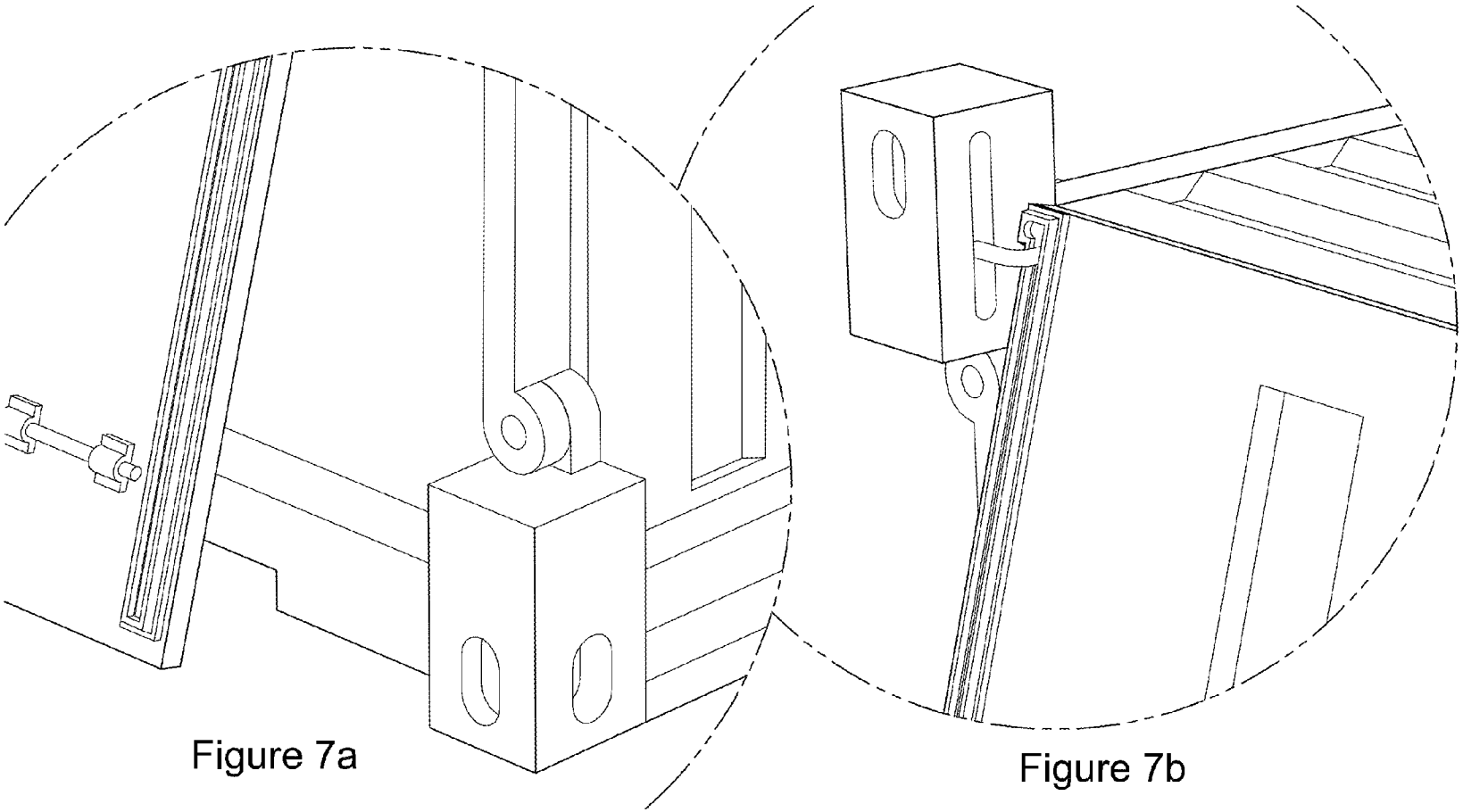
FIG. 7*a* is an enlarged view showing a bottom corner of the container when the door as shown in FIG. 6*a* is departing from the bottom corner during operation.
FIG. 7*b* is an enlarged view showing the folding hinge of FIGS. 6*a*-6*c*, and the door when the door is departing from the end of the container.

FIG. 6*a* shows one of the top corners, or the connector 8*a*, at the proximal end. There is provided a hinge means at the corner. It is to be understood that there is a corresponding hinge means at the opposite end, i.e. at the connector 10*a*. There is thus a pair of such hinge means for controlling sliding movement of the door 20. The two hinge means together form a pivotable mechanism in the form of a pair of floating hinges which allows the door 20 not only to pivot upwardly but also to slide to above the top wall 22 of the container 2. Each hinge means includes an extension bar 24 with an enlarged end extended from a top corner of the door 20 and received in a guide 26 of the connector 8*a*.

The opposite end of the bar 24 is received in a groove 28 vertically disposed on the edge of the door 20. FIG. 6*b* shows a side view of the extension bar 24 of the hinge means. FIGS. 6*a*-6*c* show how the enlarged end of the extension bar 24 is received in the vertically disposed guide 26 of the connector 8*a* at one end, and in the groove in the opposite end 28. When the door 20 is disposed in a vertical configuration closing the end of the outer section 4, the enlarged end of the extension bar is disposed in a lower region of the guide 26, and the opposite end of the extension bar 24 is positioned in the upper end of the groove 28. Please see FIGS. 6*a*-7*b*. When the door 20 is upwardly lifted and being slid to lie on top of the outer section 4, the enlarged end of the bar 24 floats towards the upper end of the guide 26, and the opposite end of the bar 24 slides towards and then positions to a lower end of the groove 28 of the door 20.

Figure 8:
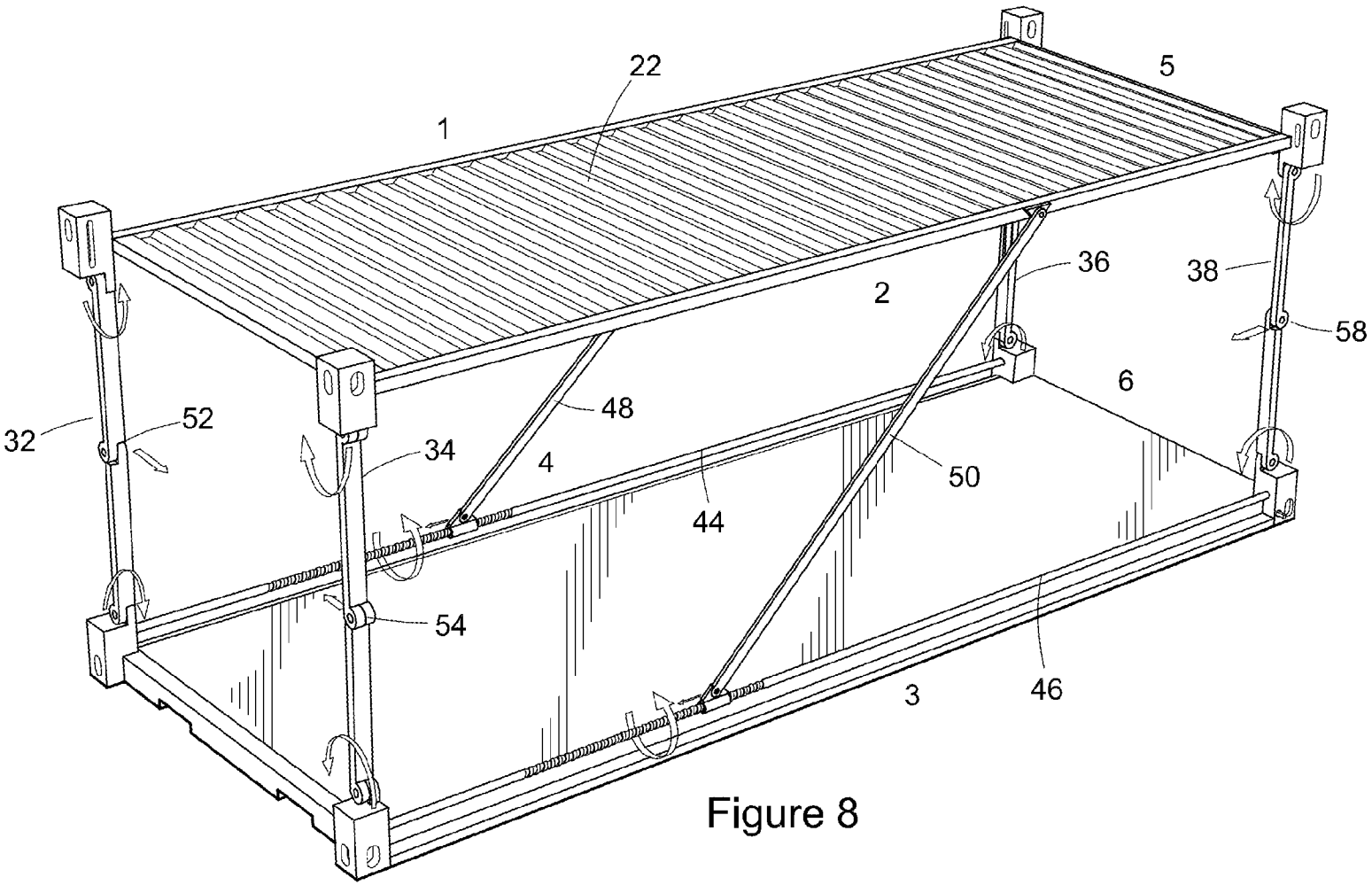
FIG. 8 is a perspective view showing an external section of the container of FIG. 1, but with side walls and the door removed.
Figure 9:
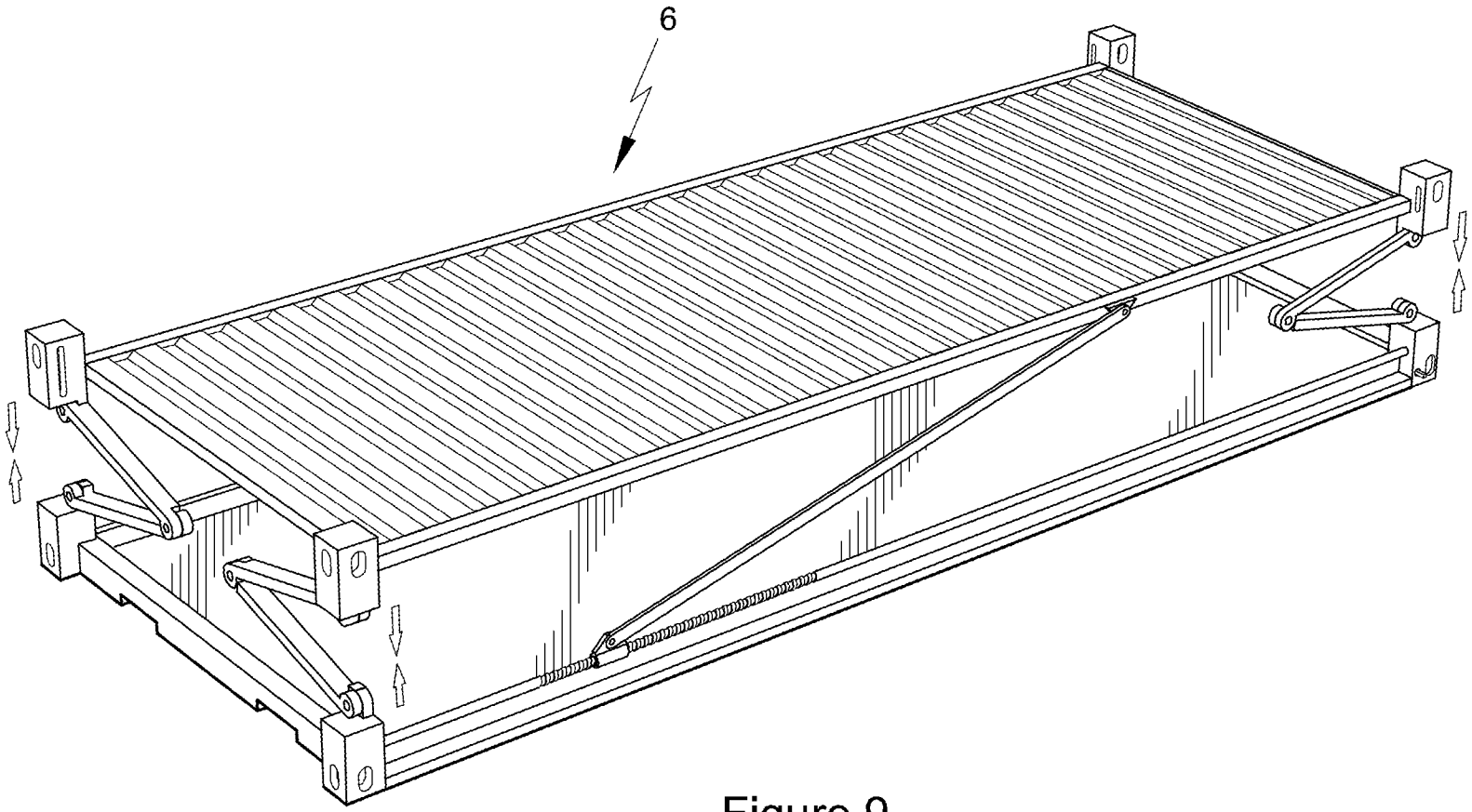
FIG. 9 is a perspective view of the container of FIG. 8, but in a different configuration.

FIGS. 8-9 illustrate the overall construction of the outer section 4, the top wall 22 and the bottom wall 20 of the outer section 4, how the top wall 22 is supported above the bottom wall 30 and how the outer section 4 can be flattened. For ease of understanding, side walls of the outer section 4 and the door 20 are removed for illustration. FIG. 8 shows the outer section 4 in an expanded configuration. The outer section has foldable means for supporting the top wall. The foldable means has two legs 32, 34 at one end adjacent the door 20 for connecting the top and bottom connectors 8*a*, 10*a*, 8*b*, 10*b*, and another two legs 36, 38 at the opposite end for connecting the top and bottom connectors 12*a*, 14*a*, 12*b*, 14*b*. The four legs 32, 34, 36, 38 provide primary mechanical support and to hold up the top wall 22 via the connectors. The slide-in section 6 also has two legs 40, 42 similar to the legs 32, 34, 36, 38 of the outer section 4 at the far end adjacent door 44.

The foldable means is operable by a drive mechanism. The drive mechanism has two rods 44, 46 running in parallel and connecting the two bottom connectors 8*b* 10*b* at one end and the other two bottom connectors 12*b*, 14*b* at the opposite end. The two rods 44, 46 are threaded. The foldable means has a pair of elongate legs 48, 50 disposed at an angle and connecting the top wall 22 of the outer section 4 and the two rods 44, 46. One end of the elongate legs 48, 50 are fixedly but pivotably connected the top wall 22, and the opposite end of the elongate legs 48, 50 are threadedly connected to the treaded section of the two elongate rods 44, 46 such that it can slide back and forth along the elongate rods 44, 46 at the threaded region.

When the outer section 4 is to be folded and to assume a collapsed configuration, the two rods 44, 46 are caused to rotate, thus pulling the lower end of the elongate legs 48, 50 towards the direction of the door 20. During this time, the four legs 32, 34, 36, 38 are caused to bend at their hinges 52, 54, 56, 58. When these both occur, the top wall 22 of the container is caused to move towards the bottom wall. The arrangement of the hinges of the two pairs of legs (32, 34), (36, 38) is somewhat different. The hinges 52, 54 of the first pair of legs 32, 34 adjacent the door 20 at one end of the outer section 4 is designed such that during folding, the legs 32, 34 and their hinges 52, 54 move towards each other. The pair of legs 36, 38 at the opposite end of the outer section 4 is designed such that during folding, the legs 36, 38 and their hinges 56, 58 move towards the end where the door 20 is situated. FIG. 9 shows the slide-in section 6 in a collapsed configuration.

Figure 10:
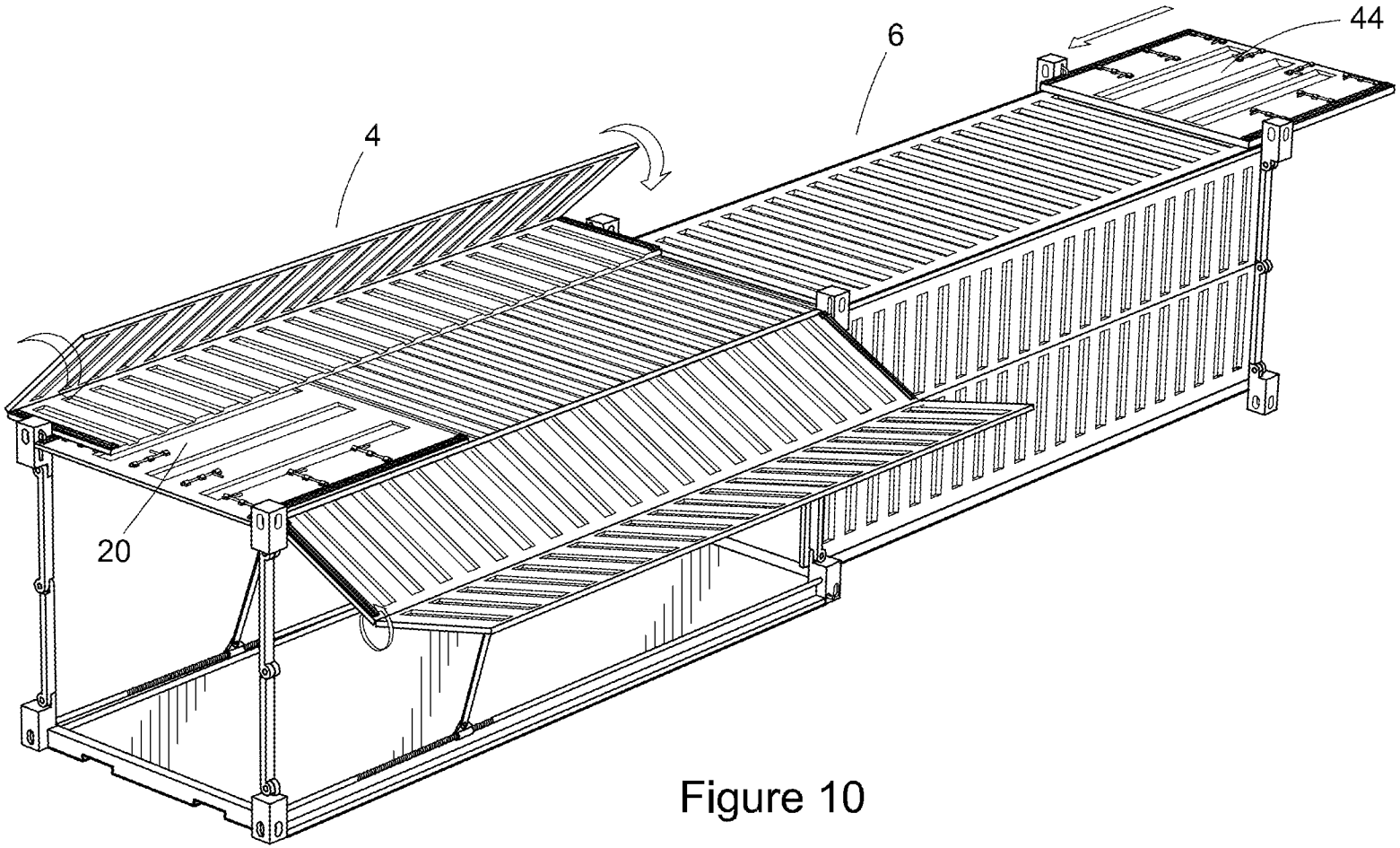
FIGS. 10-14 are a series of successive diagrams showing how the container is processed to assume a fully collapsed configuration.
Figure 11:
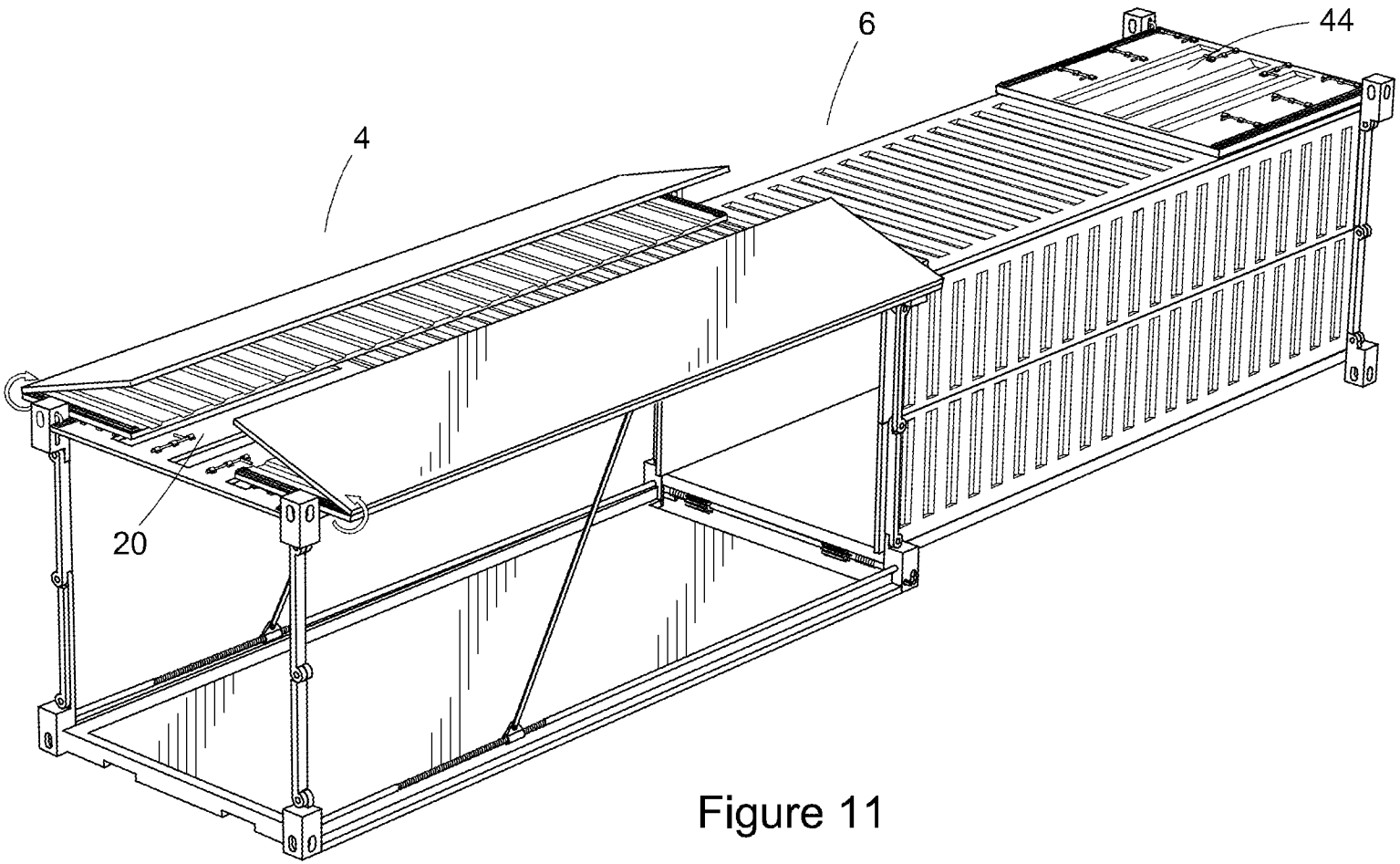

FIGS. 10-11 illustrate how the slide-in section 6 is received in the outer section 4 and how the two sections 4, 6 are flattened. The doors 20, 44 of the outer section 4 and the slide-in section 6 are firstly moved above and lie on the top wall 22 of the freight container 2. Then the side walls of the outer section 4 are folded at their mid-region and swing to rest on the top wall 22 of the freight container 2. The side walls of the slide-in section 6 are also folded at their mid-regions, although they remain between the top wall and the bottom wall of the slide-in section 6.

Figure 12:
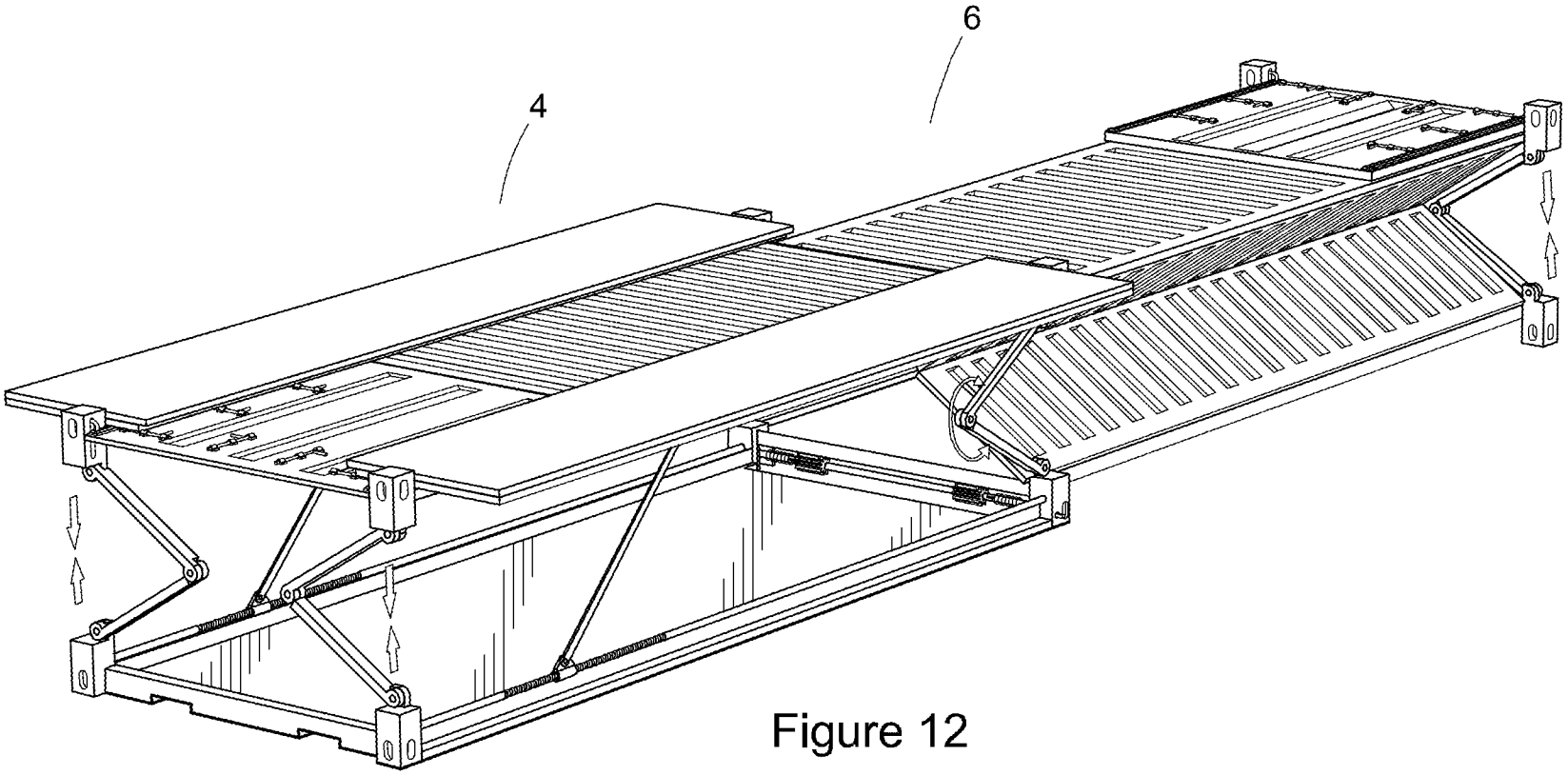
Figure 13:
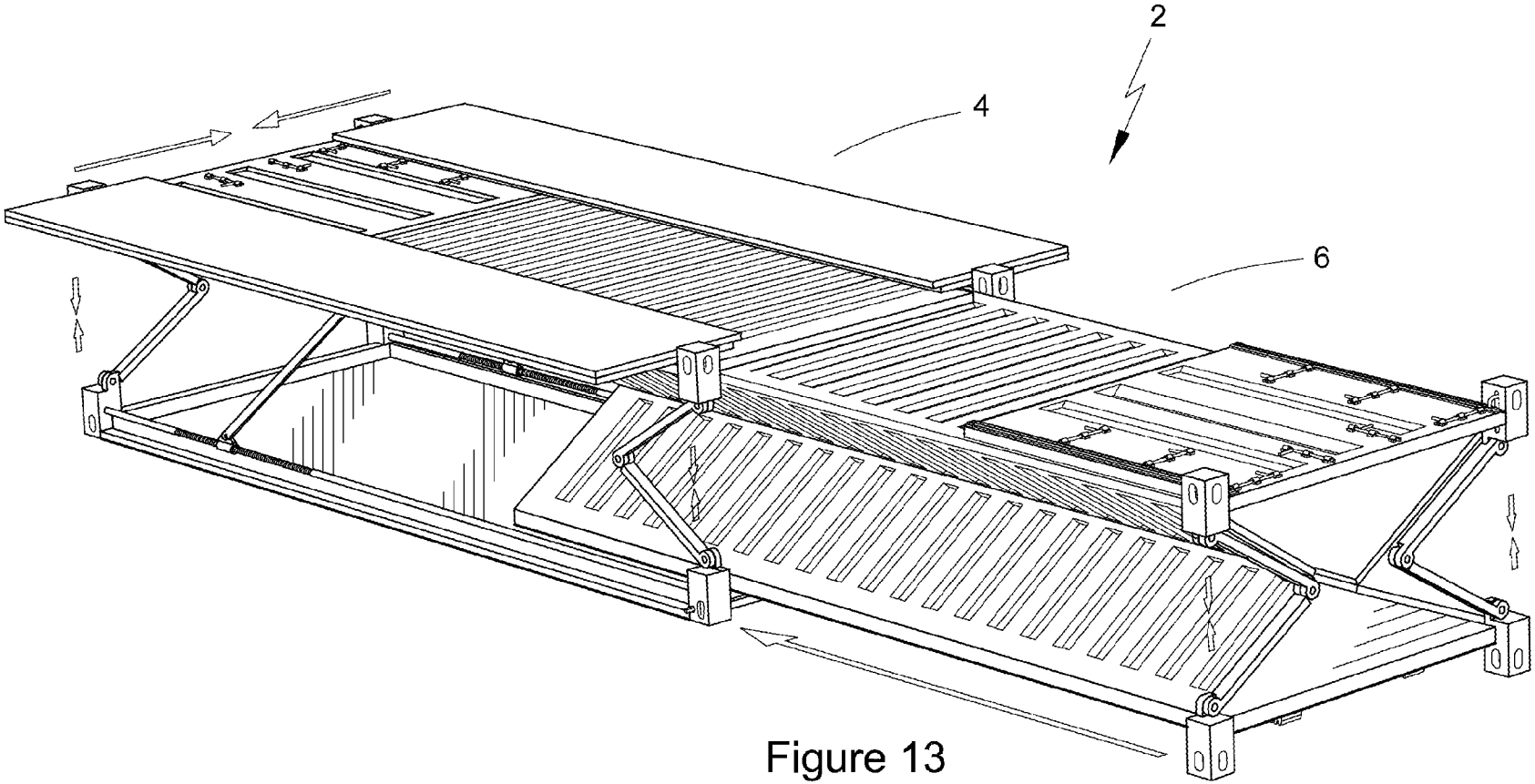
Figure 14:
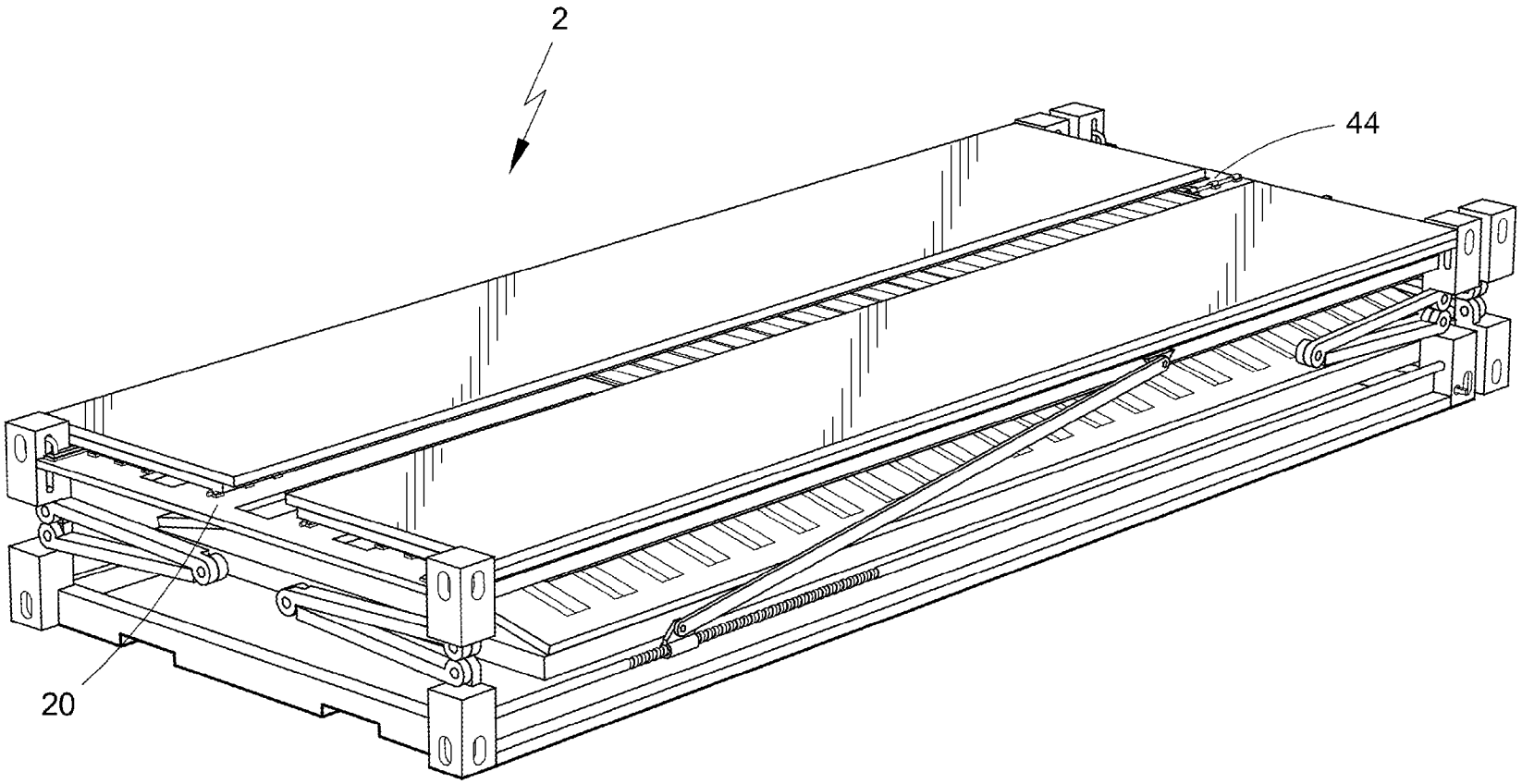
Figure 15:
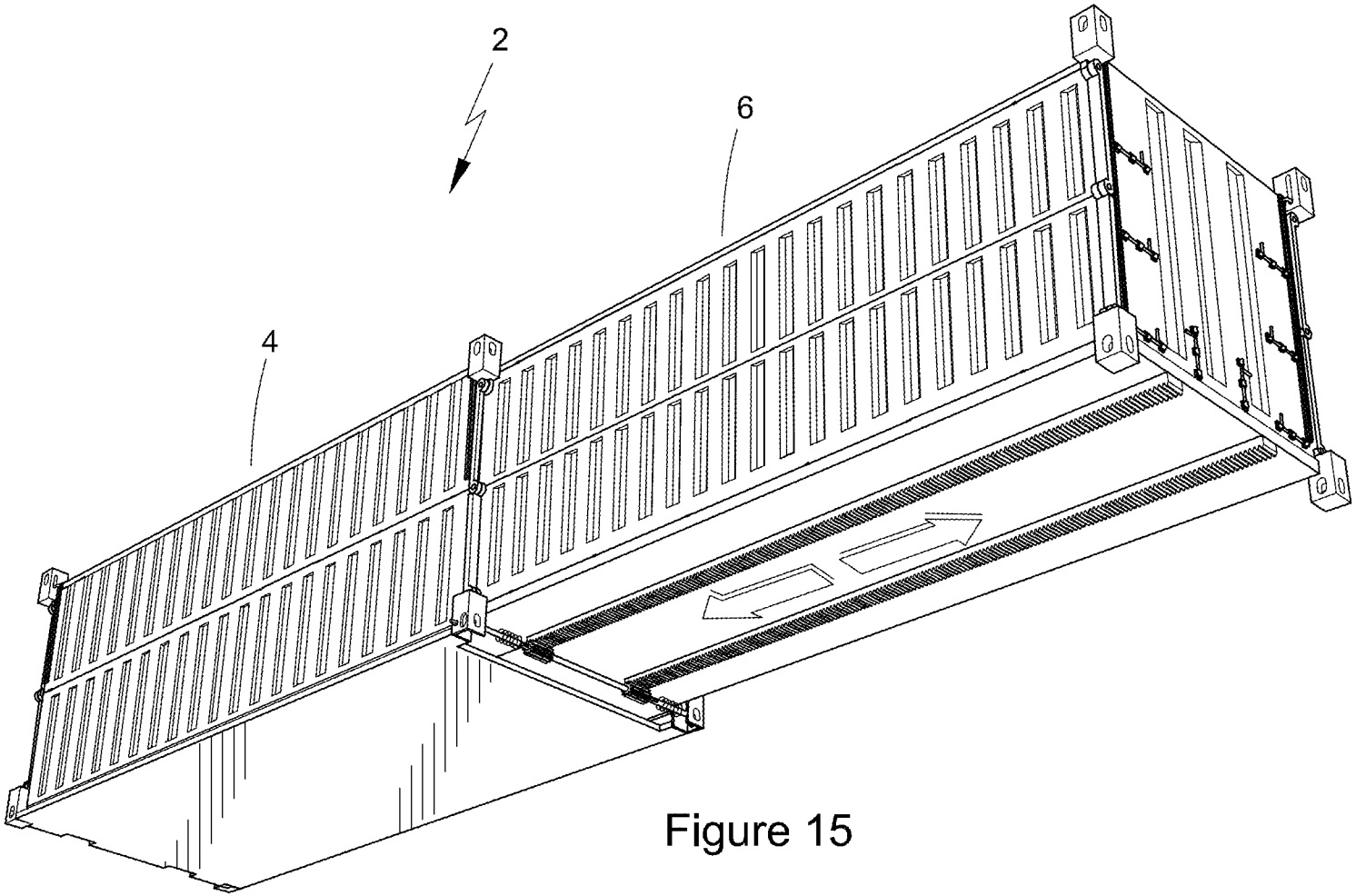
FIG. 15 is a perspective view showing a bottom view of the container of FIG. 1.
Figure 16:
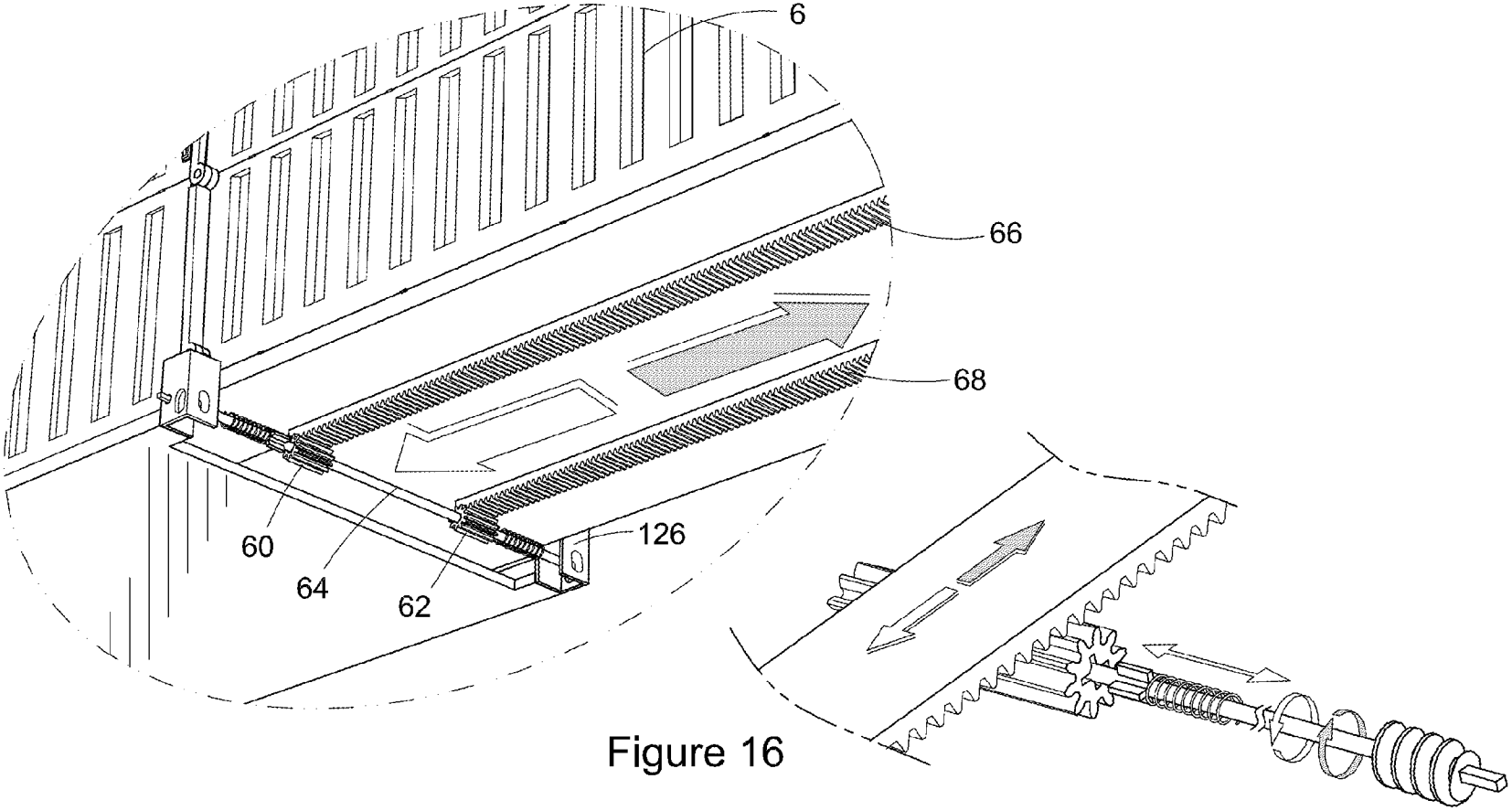
FIGS. 16-18*b* are schematic diagrams showing how an embodiment of a mechanism enabling flattening and fully collapsing of the container.

FIGS. 12-13 illustrate how the slide-in section 6 is received in the outer section 4. FIG. 14 shows the freight container 2 in an almost fully flattened and collapsed configuration.

FIGS. 15-18*b* illustrate operation of a mechanism for controlling vertical expansion or collapsing of the container, and for effecting sliding of the slide-in section 6 within the outer section 4. The mechanism comprises the drive mechanism as explained above, and further a cam mechanism. The cam mechanism includes a pair of geared rollers 60, 62 in the form of pinions installed on an elongate transverse rod 64 connecting the two bottom connectors 12*b*, 14*b*. Bottom wall of the slide-in section 6 is provided with a pair of guides 66, 68 with complementary gear tracks. The gear tracks and the geared rollers 60, 68 are configured such that the slide-in section 6 can slide on the geared rollers 60, 68 when the slide-in section 6 is being fitted within or pulled out from the outer section 4.

Figures 17A, 17B:
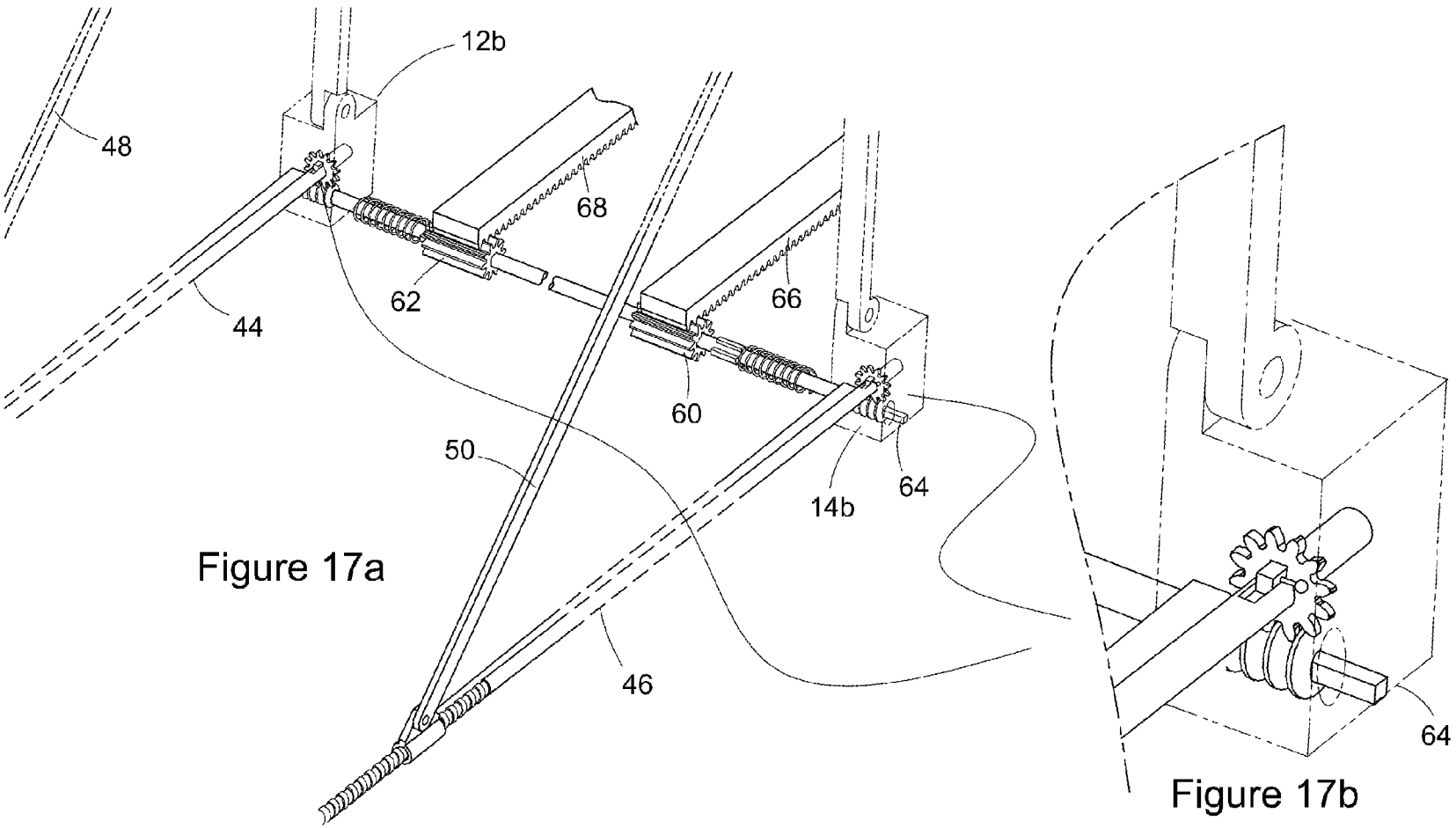

FIGS. 17*a*-17*b* show that the transverse rod 64 has a protrusion via which rotation of the transverse rod 64 is effected. When the transverse rod 64 is caused to rotate at the protrusion, the geared rollers 60, 62 are caused to rotate, thus bring the slide-in section 6 to move inwards or outwards, depending on the direction of rotation of the geared rollers 60, 62.

Figure 18B:
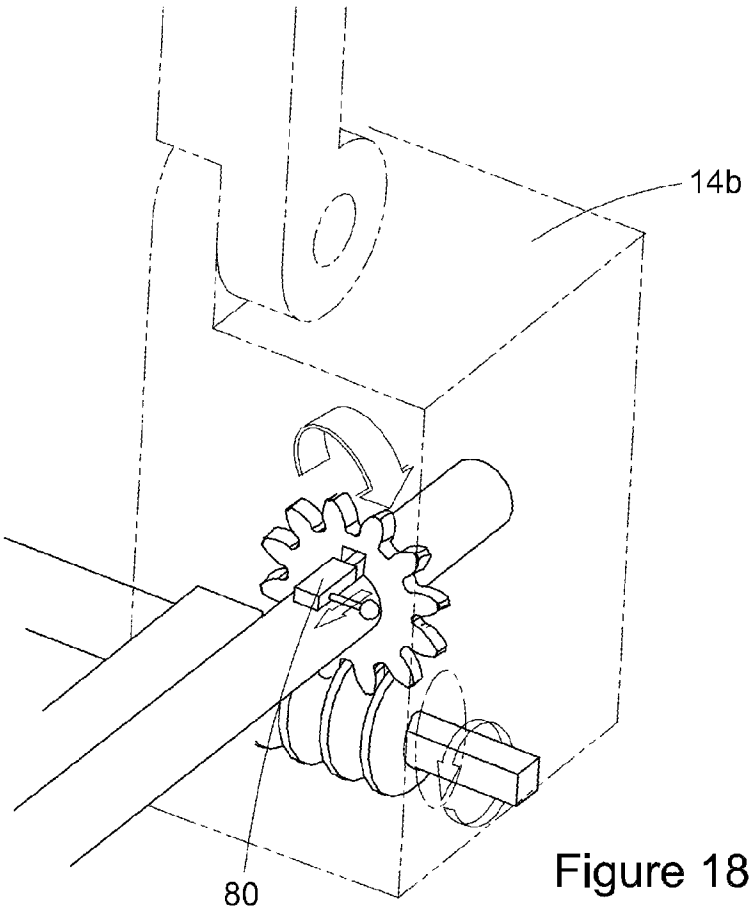
Figure 18A:
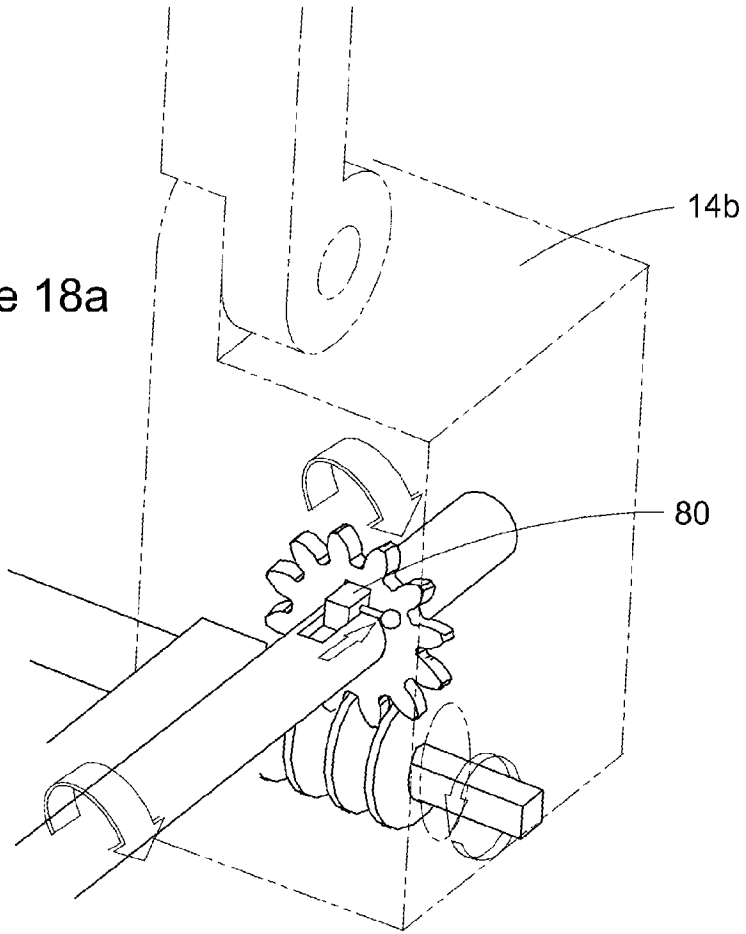

The transverse rod 64 is also connected to the threaded elongate rods. In this setting, when the transverse rod 64 is caused to rotate, the threaded elongate rods 44, 46 are also caused to rotate simultaneously. Rotation of the threaded elongate rods 44, 46 causes the lower end of the leg members 48, 50 to move sideways, thus bringing the top wall 22 towards the bottom wall of the freight container 2. FIGS. 18*a*-18*b* are enlarged views showing essential portions of the drive mechanism and cam mechanism. The freight container comprises a switch means 80 for adjusting whether the freight container 2 can be adjusted to shorten in length only, or to shorten in length and to collapse in height simultaneously, or to collapse in height only but not shortened in length. In an alternative setting, the switch means 80 is adjusted such that the pair of elongate rods 44, 46 disengages from the transverse rod 64. In this setting, rotation of the transverse rod 64 only brings about shortening of the freight container 2 and not collapsing of the freight container 2 in height. The switch means 80 is illustrated in FIGS. 17*a*-18*b*.

Figure 19:
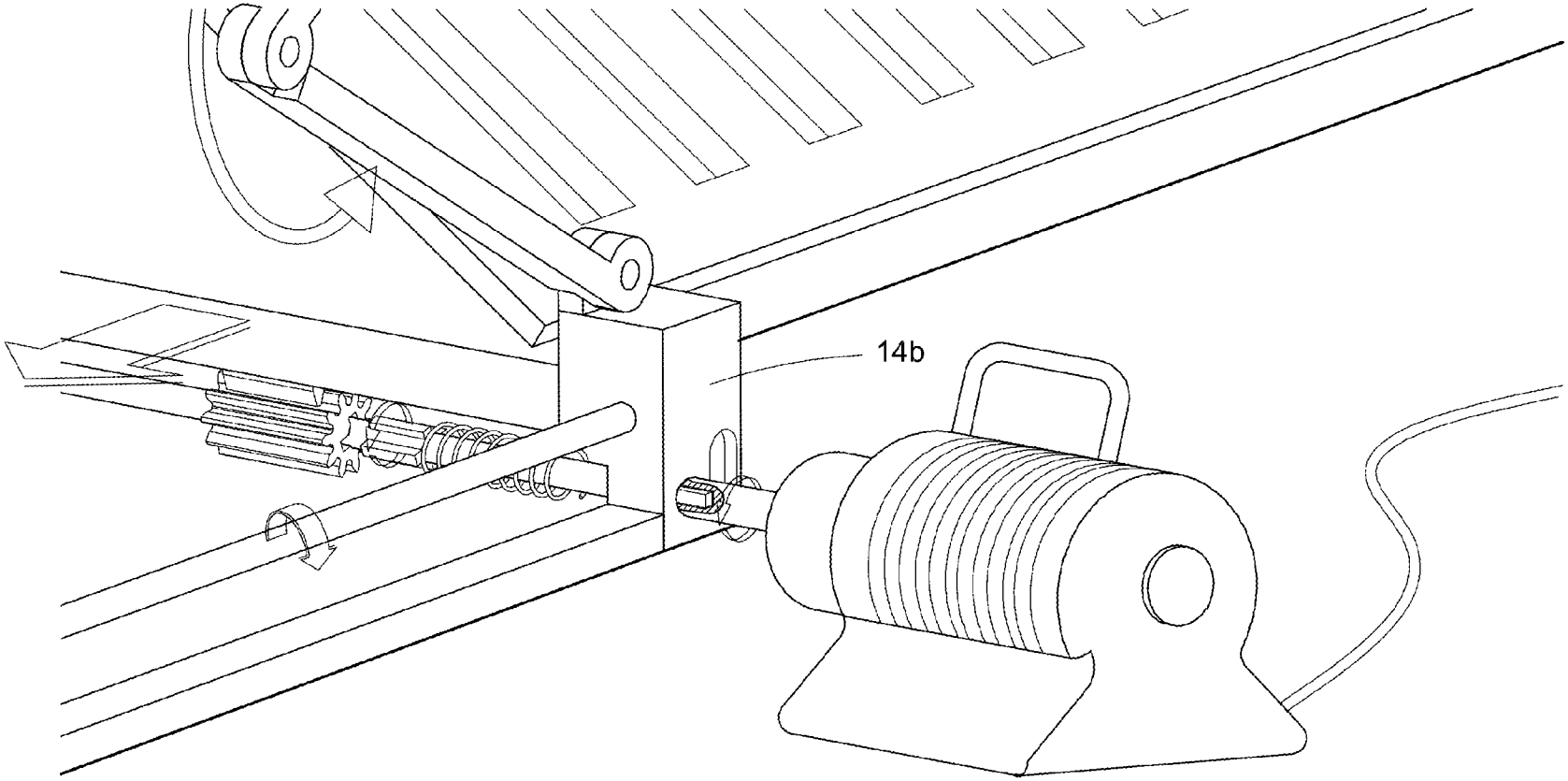
FIGS. 19-21 shows how an embodiment of operation of flattening and collapsing of the container of FIGS. 16-18*b.
Figure 20:
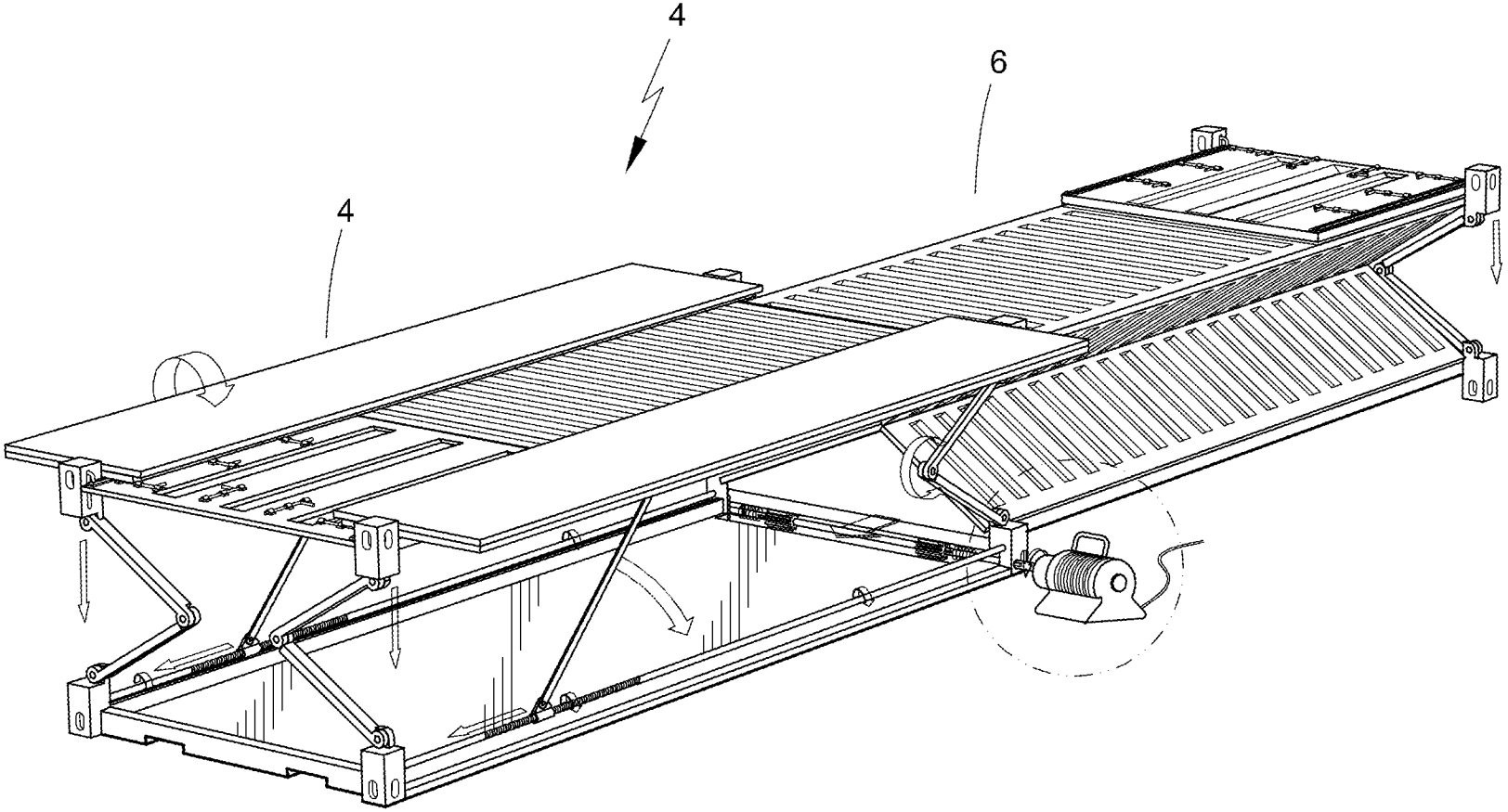
Figure 21:
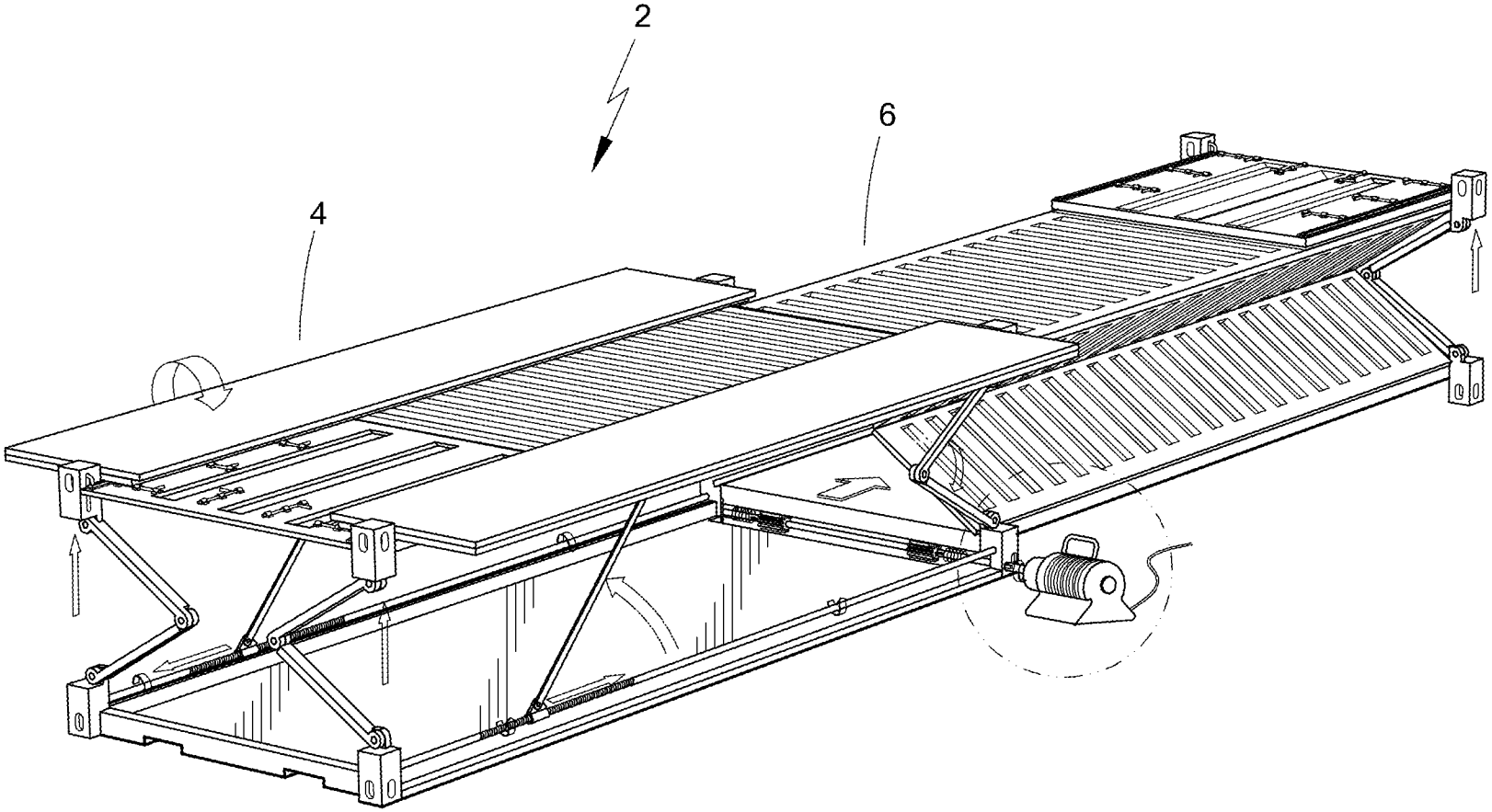

The operation of the drive mechanism and the cam mechanism can be performed by a simple hand tool for rotation of the transverse rod 64. In an alternative embodiment, the drive mechanism and the cam mechanism may be operated by a motorized tool, as shown in FIGS. 19 to 21, for rotating the transverse rod 64.

Figure 22:
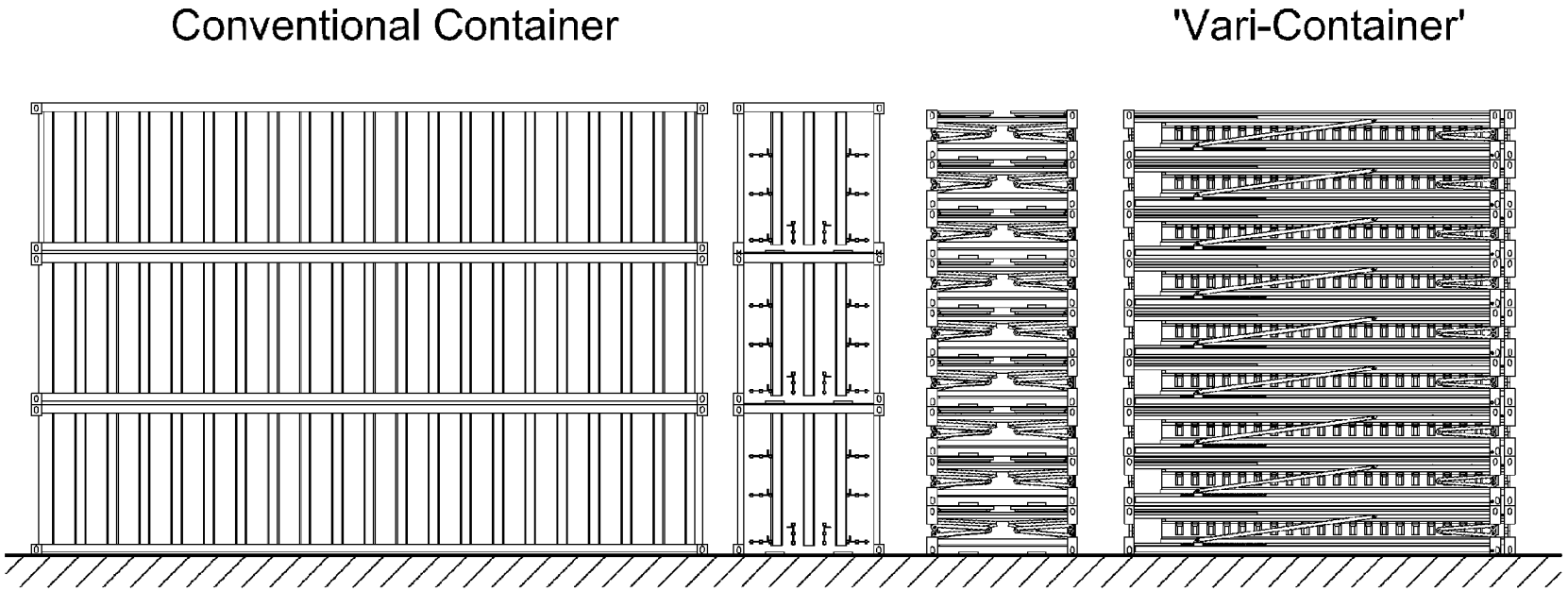
* and FIG. 22 illustrates stackability of conventional freight containers and stackability of plurality of the freight containers of FIG. 1 when collapsed.

FIG. 22 is a schematic view illustrating, on the left, three conventional freight containers stacked on top of each other. FIG. 22, on the right, illustrate an embodiment of nine freight containers in accordance with the present invention all in a fully collapsed configuration stacking on top of each other. It is shown that the height of the three conventional freight containers stacked on top of each other and the height of the nine freight containers all in a fully collapsed configuration stacking on top of each other have equal height and volume. In other words, once the embodiment of freight container in accordance with the present invention is fully collapsed their volume is reduced to one-third. There is accordingly huge savings in transporting fully contracted and collapsed containers made in accordance with the present invention.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose. For instance, in the second configuration the freight container may be shortened with the second portion folded to situate above or at a side of the first portion.

The invention claimed is:

1. A freight container comprising a first portion and a second portion, wherein said container is adapted to assume a first configuration in which said container has a maximum volume or a third configuration in which said container has a minimum volume, and wherein:

in the first configuration said second portion is extended away from said first portion;

in the first configuration side walls of said first and second portions are extending vertically in normal use;

at least some of said side walls are foldable;

in the third configuration said side walls are folded in such a way to allow top walls of said first and second portions and bottom walls of said first and second portions be brought towards and adjacent each other whereby the minimum volume of said container is achieved; and said container is adapted to assume a second configuration in which said second portion is substantially and telescopically received in said first portion but said top walls of said first and second portions are not brought towards or closer to each other.

2. A freight container as claimed in claim 1, wherein said side walls of said first portion are foldable in mid-region thereof and positionable on top of said first portion.

3. A freight container as claimed in claim 1, wherein said side walls of said second portion are foldable in mid-region thereof and adapted to be brought towards each other whereby during folding said top wall and said bottom wall of said second portion are brought towards each other.

4. A freight container as claimed in claim 1, wherein said first portion includes a door for closing an open end thereof and movable to situate above and lie on said top wall of said first portion, and said second portion includes a door for closing an open end thereof and movable to situate above and lie on said top wall of said first or second portion.

5. A freight container as claimed in claim 4, comprising floating hinges allowing said doors to move to and lie on said top wall of said first or second portion.

6. A freight container as claimed in claim 1, wherein in the first configuration the length of said container is substantially 40 feet, and in the second or third configuration the length of said container is substantially 20 feet.

7. A freight container as claimed in claim 4, comprising connectors arranged at corners of said first portion and said second portion.

8. A freight container as claimed in claim 7, wherein said connectors of said first portion and said connectors of said second portion are sized or otherwise configured differently to compensate for difference in height of said first and second portions, such that two said containers regardless of state of configuration are stackable in a levelled manner on top of each other.

9. A freight container as claimed in claim 7, comprising foldable means for supporting said top wall and said bottom wall of said first portion.

10. A freight container as claimed in claim 9, wherein at least part of or elements of said foldable means mechanically connect at least some of pairs of said connectors.

11. A freight container as claimed in claim 9, wherein said foldable means includes hinge means.

12. A freight container as claimed in claim 9, wherein said foldable means includes a pair of first foldable members movable towards each other during folding and when bringing said top walls and said bottom walls of said first and second portions towards each other.

13. A freight container as claimed in claim 9, wherein said foldable means includes a pair of second foldable members, and hinge members of said second foldable members are movable towards said door of said first portion.

14. A freight container as claimed in claim 1, comprising a drive mechanism for controlling vertical expansion or collapsing of said container.

15. A freight container as claimed in claim 14, wherein the drive mechanism includes a pair of threaded elongate rods extending from front end to rear end of said first portion, and a pair of leg members movable with respect to and threadedly connected to said threaded elongate rods at one end and pivotably connected to said top wall of said first portion at the other end, such that when said leg members are caused to move along said threaded rods, said top wall and said bottom wall of said first container are brought towards or away from each other.

16. A freight container as claimed in claim 1, comprising a cam mechanism for effecting sliding of said second portion within said first portion.

17. A freight container as claimed as claimed in claim 16, wherein the cam mechanism includes at least a roller at a lower end of said first portion and a guide defining an engaging surface at bottom surface of said second portion, such that said second portion is slidable towards said first portion when the engaging surface of said guide slides on said roller.

18. A freight container as claimed in claim 17, wherein said roller is provided with teeth, and said engaging surface is provided with complementary teeth, for assisting movement of said second portion on said roller.

19. A freight container as claimed in claim 1, comprising locking means for locking said first portion and said second portion in desired configuration.

20. A freight container comprising a first portion and a second portion, wherein said container is adapted to assume a first configuration in which said container has a maximum volume, a third configuration in which said container has a minimum volume, and a second configuration in which said container has a volume between the minimum volume and the maximum volume, and wherein:

in the first configuration said second portion is extended away from said first portion;

in the first configuration side walls of said first and second portions are extending vertically in normal use;

at least some of said side walls are foldable;

in the third configuration said side walls are folded in such a way to allow top walls of said first and second portions and bottom walls of said first and second portions be brought towards and adjacent each other whereby the minimum volume of said container is achieved;

said side walls of said first portion are foldable in mid-region thereof and positionable on top of said first portion; and said first portion includes a door for closing an open end thereof and movable to situate above and lie on said top wall of said first portion, and said second portion includes a door for closing an open end thereof and movable to situate above and lie on said top wall of said first or second portion.

* * * * *